US007747178B2

(12) United States Patent
Tsukamoto

(10) Patent No.: US 7,747,178 B2
(45) Date of Patent: Jun. 29, 2010

(54) IMAGE FORMING APPARATUS

(75) Inventor: Yasumasa Tsukamoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 7 days.

(21) Appl. No.: 12/008,881

(22) Filed: Jan. 15, 2008

(65) Prior Publication Data

US 2008/0240742 A1 Oct. 2, 2008

(30) Foreign Application Priority Data

Mar. 27, 2007 (JP) ..... 2007-082220

(51) Int. Cl.
*G03G 15/00* (2006.01)

(52) U.S. Cl. ..... 399/15; 399/43; 399/72; 399/82

(58) Field of Classification Search ..... 399/15, 399/43, 59, 72, 77, 82
See application file for complete search history.

(56) References Cited

U.S. PATENT DOCUMENTS

| | | | | |
|---|---|---|---|---|
| 3,936,180 | A * | 2/1976 | Willard et al. | 399/10 |
| 4,448,515 | A * | 5/1984 | Ishikawa | 399/15 |
| 5,809,371 | A * | 9/1998 | Inui et al. | 399/81 |
| 5,835,815 | A * | 11/1998 | Kubo et al. | 399/8 |
| 6,122,457 | A * | 9/2000 | Kizaki | 399/11 |
| 6,175,700 | B1 * | 1/2001 | Miller et al. | 399/72 |
| 6,185,402 | B1 * | 2/2001 | Linssen | 399/301 |
| 6,945,715 | B2 * | 9/2005 | Nakatani et al. | 400/61 |
| 6,973,273 | B2 * | 12/2005 | Kuboki | 399/15 |
| 7,345,784 | B2 * | 3/2008 | Osawa et al. | 358/1.2 |

FOREIGN PATENT DOCUMENTS

| | | |
|---|---|---|
| JP | 08-197779 A | 8/1996 |
| JP | 2004-284323 A | 10/2004 |

* cited by examiner

*Primary Examiner*—David M Gray
*Assistant Examiner*—Francis Gray
(74) *Attorney, Agent, or Firm*—Frishauf, Holtz, Goodman & Chick, P.C.

(57) ABSTRACT

Disclosed an image forming apparatus including: a first input section to receive a setting instruction of an output cycle of sample output; a second input section to receive an instruction of immediate output of the sample output; an image forming section; an ejection section; a control section to count a number of the recording media, the control section judging timing of executing the sample output, based on a counted value of the number of recording media and an set output cycle, the control section ejecting sample output matter according to a judgment result, the control section simultaneously initializing the counted value, the control section allowing the image forming section to form an image and eject the sample output matter when the immediate output of the sample output is instructed with the second input section, the control section simultaneously initializing the counted value.

4 Claims, 10 Drawing Sheets

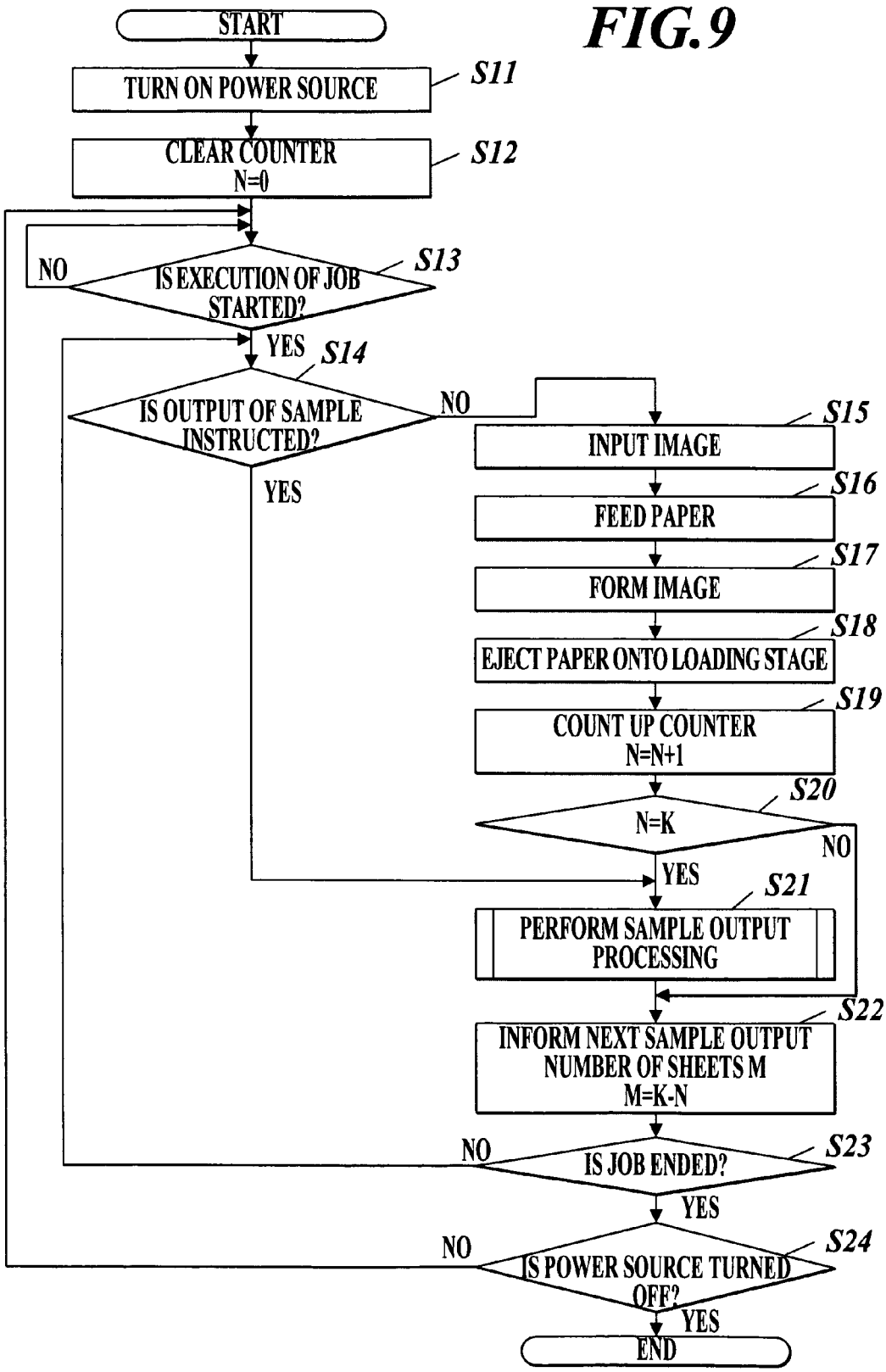
FIG. 9
START
TURN ON POWER SOURCE
S11
CLEAR COUNTER
N=0
S12
IS EXECUTION OF JOB STARTED?
S13
NO
YES
IS OUTPUT OF SAMPLE INSTRUCTED?
S14
NO
YES
INPUT IMAGE
S15
FEED PAPER
S16
FORM IMAGE
S17
EJECT PAPER ONTO LOADING STAGE
S18
COUNT UP COUNTER
N=N+1
S19
N=K
S20
NO
YES
PERFORM SAMPLE OUTPUT PROCESSING
S21
INFORM NEXT SAMPLE OUTPUT NUMBER OF SHEETS M
M=K-N
S22
IS JOB ENDED?
S23
NO
YES
IS POWER SOURCE TURNED OFF?
S24
NO
YES
END

IMAGE FORMING APPARATUS

BACKGROUND

1. Field of the Invention

The present invention relates to an image forming apparatus.

2. Description of Related Art

In recent years, a technique of printing a sample image (hereinafter referred to as sample printing) during printing regular images (hereinafter referred to as regular printing) has been used in order to detect quality deterioration (such as density reduction and contamination) of printed matter at the time of printing with a copier and the like, in particular, at the time of printing in a large quantity.

For example, a technique of performing sample printing every predetermined cycle of the number of sheets during regular printing (see, for example, Japanese Patent Application Laid-Open Publication No. Hei 8-197779), and a technique of performing sample printing in response to an instruction from an operator during regular printing (see Japanese Patent Application Laid-Open Publication No. 2004-284323) have been used.

However, when an operator instructs sample printing at arbitrary timing in the case where sample printing at each predetermined cycle of the number of sheets is set, a sample print to be ejected every predetermined cycle of the number of sheets and a sample print to be ejected at the timing instructed by the operator are severally independently processed. Consequently, when the timing of the ejection of the sample print in accordance with the instruction of the operator and the timing of the ejection of the sample print at each predetermined cycle of the number of sheets are short from each other, the sample prints are ejected in series in a short cycle, and one sample print becomes useless. The unnecessary sample printing is thus executed, and the techniques have a problem of poor usability.

SUMMARY

According to the first aspect of the invention, an image forming apparatus includes: a first input section to receive a setting instruction of an output cycle of sample output; a second input section to receive an instruction of immediate output of the sample output; an image forming section to form an image onto a recording medium based on image data; an ejection section to eject the recording medium subjected to image forming; a control section to count the number of the recording medium ejected by the ejection section, the control section to judge timing of executing the sample output, at which the image forming section forms an image, based on a counted value of the number of the recording media and the output cycle set by the first input section, the control section to execute the sample output of the sample output matter formed by the image forming section according to a judgment result and simultaneously initializes the counted value, and the control section to execute the sample output of the sample output matter formed by the image forming section when the immediate output of the sample output is instructed with the second input section and simultaneously initializes the counted value.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein;

FIG. 9 is a flow chart showing the image formation processing of the embodiment.

DETAILED DESCRIPTION OF THE PREFERRED EMBODIMENT

In the following, the preferred embodiment of the present invention will be described in detail with reference to the attached drawings. The scope of the invention is not limited to the shown examples.

Figure 1:
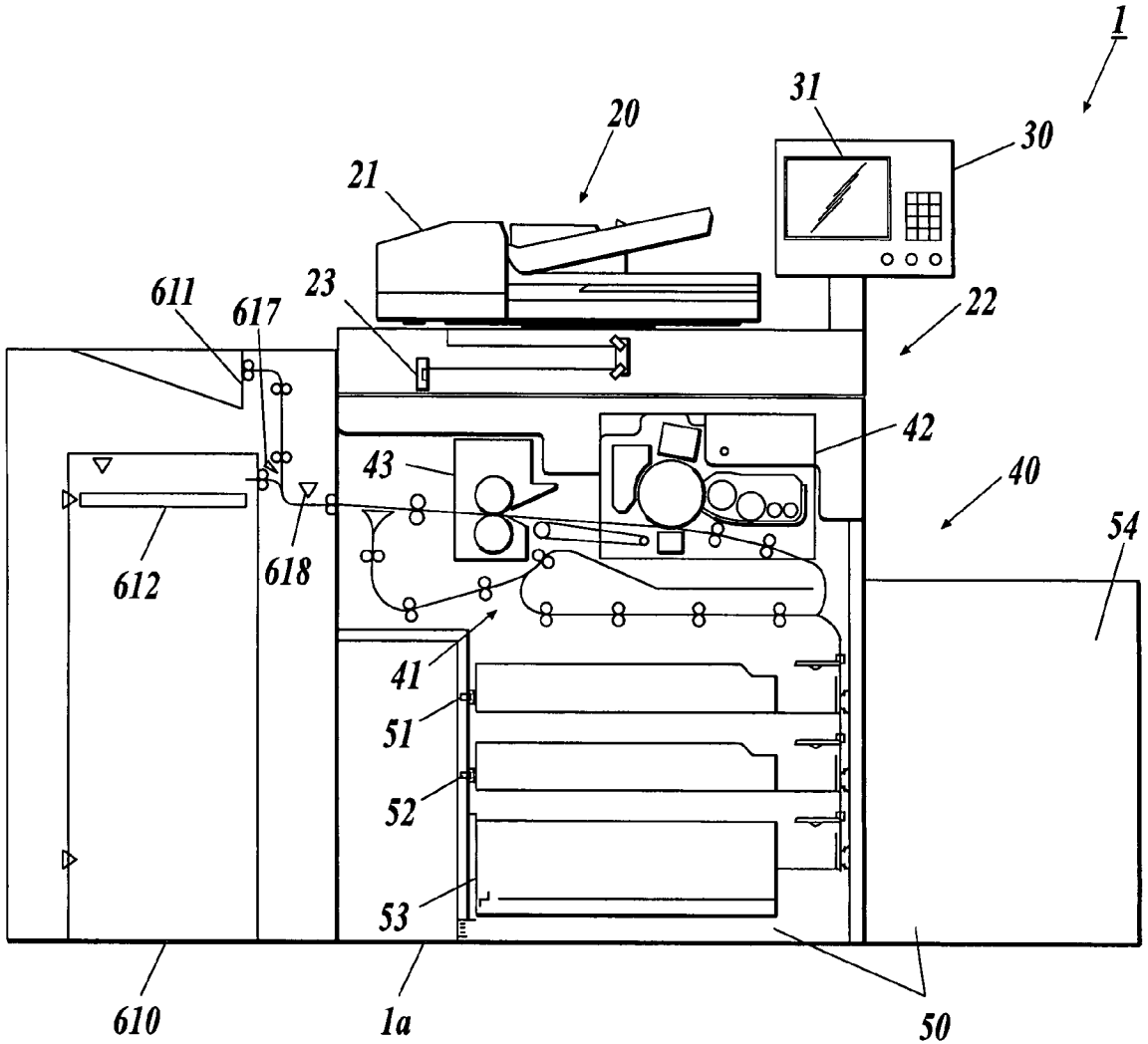
FIG. 1 is a view showing the configuration of an image forming apparatus of an embodiment.
Figure 2A:
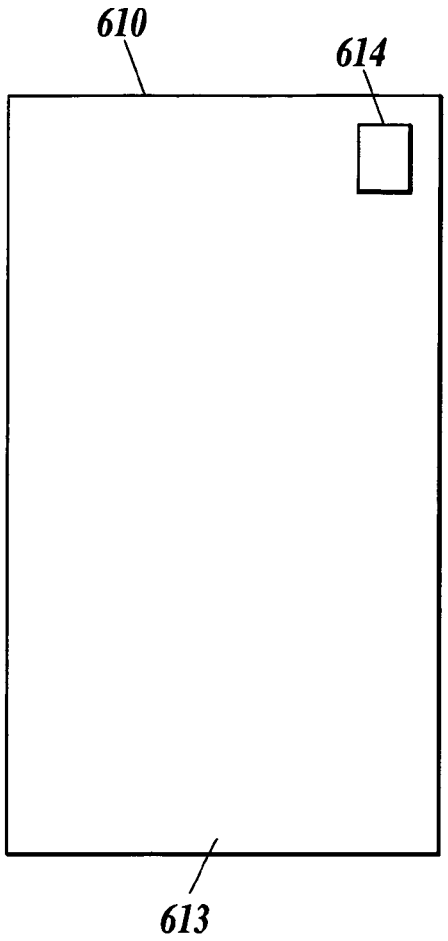
FIG. 2 is a view showing the configuration of a stacker in the states in which the door thereof is closed and opened.
Figure 2B:
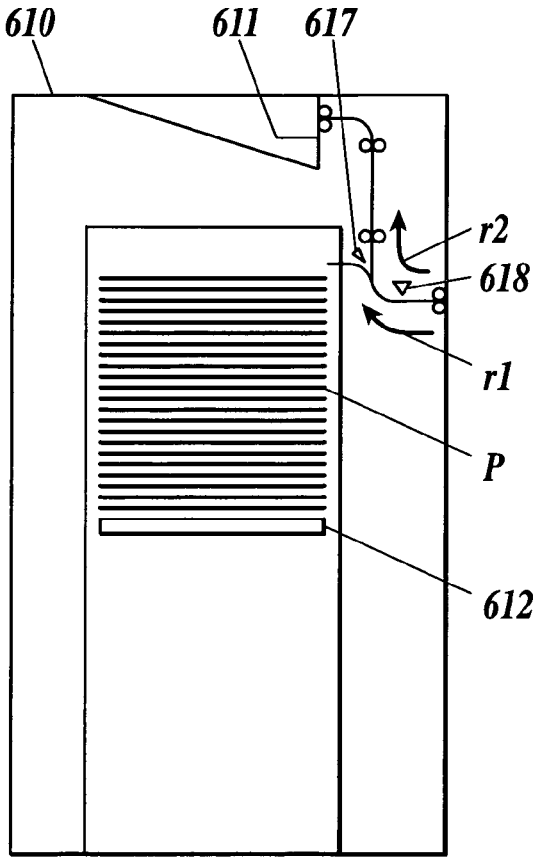
Figure 3:
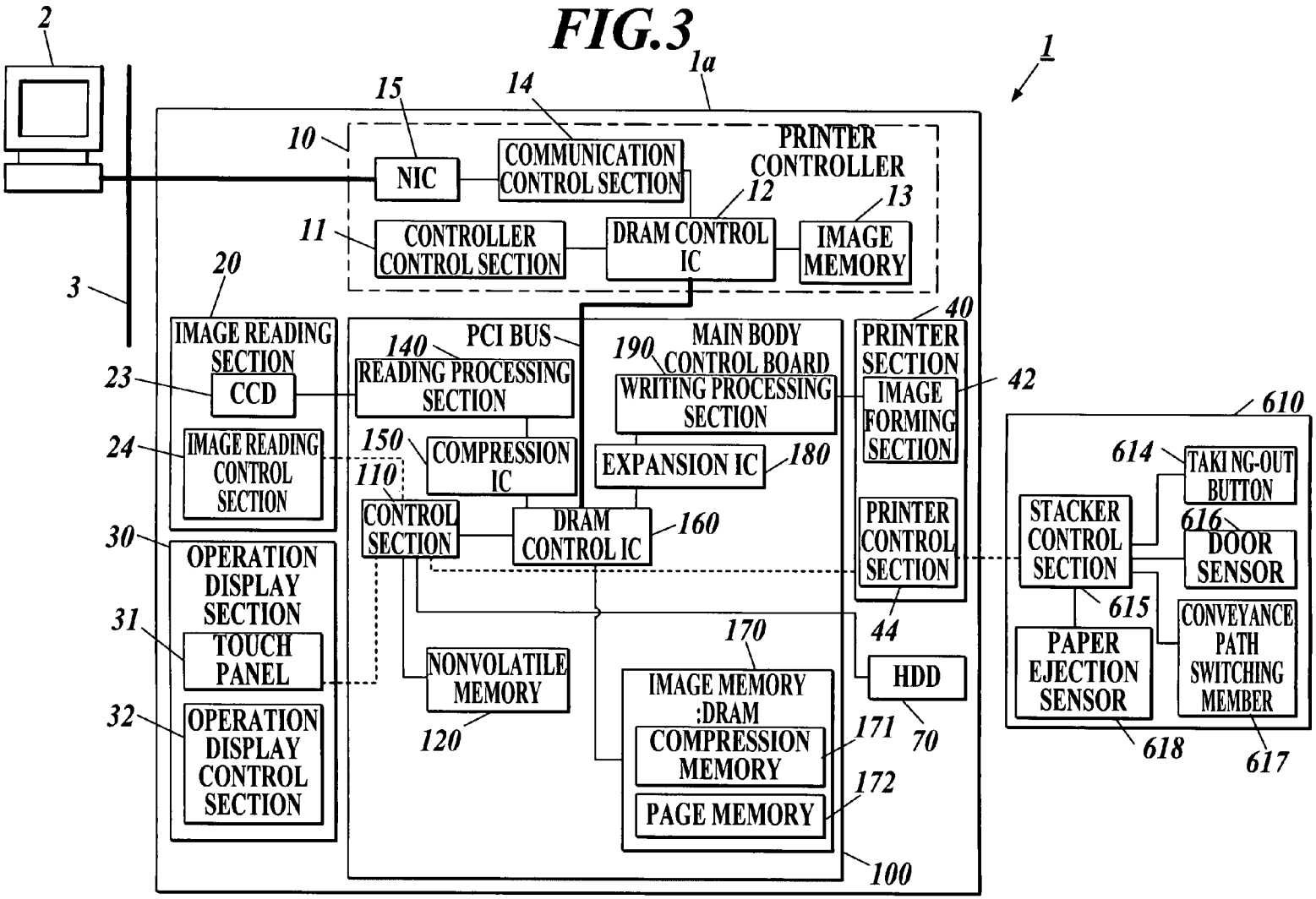
FIG. 3 is a diagram showing the internal configuration of the image forming apparatus.

The configuration of the apparatus of the embodiment is first described with reference to FIGS. 1-3. FIG. 1 shows the configuration of an image forming apparatus 1 of the embodiment. FIG. 2 shows the configuration of a stacker 610 in the states of closing the door 613 thereof and of opening the door 613. FIG. 3 shows the internal configuration of the image forming apparatus 1.

The image forming apparatus 1 of the embodiment is described with reference to FIG. 1. As shown in FIG. 1, the image forming apparatus 1 is composed of an image reading section 20; an operation display section 30 as a first input section, a second input section, and an informing section; a printer section 40; a paper feeding unit 50; and the stacker 610 as an ejection section. The main body unit 1*a* of the image forming apparatus 1 is composed of the image reading section 20, the operation display section 30, the printer section 40, and the paper feeding trays 51-54 of the paper feeding unit 50. Although the embodiment is described on the supposition that the image forming apparatus 1 is a copier, the image forming apparatus is not limited to the copier. For example, the other image forming apparatus such as a printer and a multi function printer (MFP) may be adopted as the image forming apparatus 1.

The image reading section 20 is composed of an auto document feeder (ADF) section 21, which is an automatic paper feeding mechanism, and a scanner section 22. The ADF section 21 conveys an original document placed on a document stand. The scanner section 22 performs the light scanning of the document conveyed by the ADF section 21 through a contact glass, or performs the light scanning of the document placed on a platen glass. The scanner section 22 then reads the image recorded on the document by performing the photoelectric conversion of the scanned light with a charge-coupled device (CCD) 23 to obtain the data of the document image.

The data of the document image read by the image reading section 20 is subjected to various kinds of image processing by a main body control board 100, which will be described below, and is output to the printer section 40 as image data for printing.

The operation display section 30 is composed of a liquid crystal display (LCD), a touch panel 31 provided to cover the LCD, and a not-shown group of operation keys. The operation display section 30 receives an input of a user, and outputs the input information to the main body control board 100. Moreover, the operation display section 30 displays various setting screens, various processing results, and the like, in accordance with display signals input from the main body control board 100.

Figure 4:
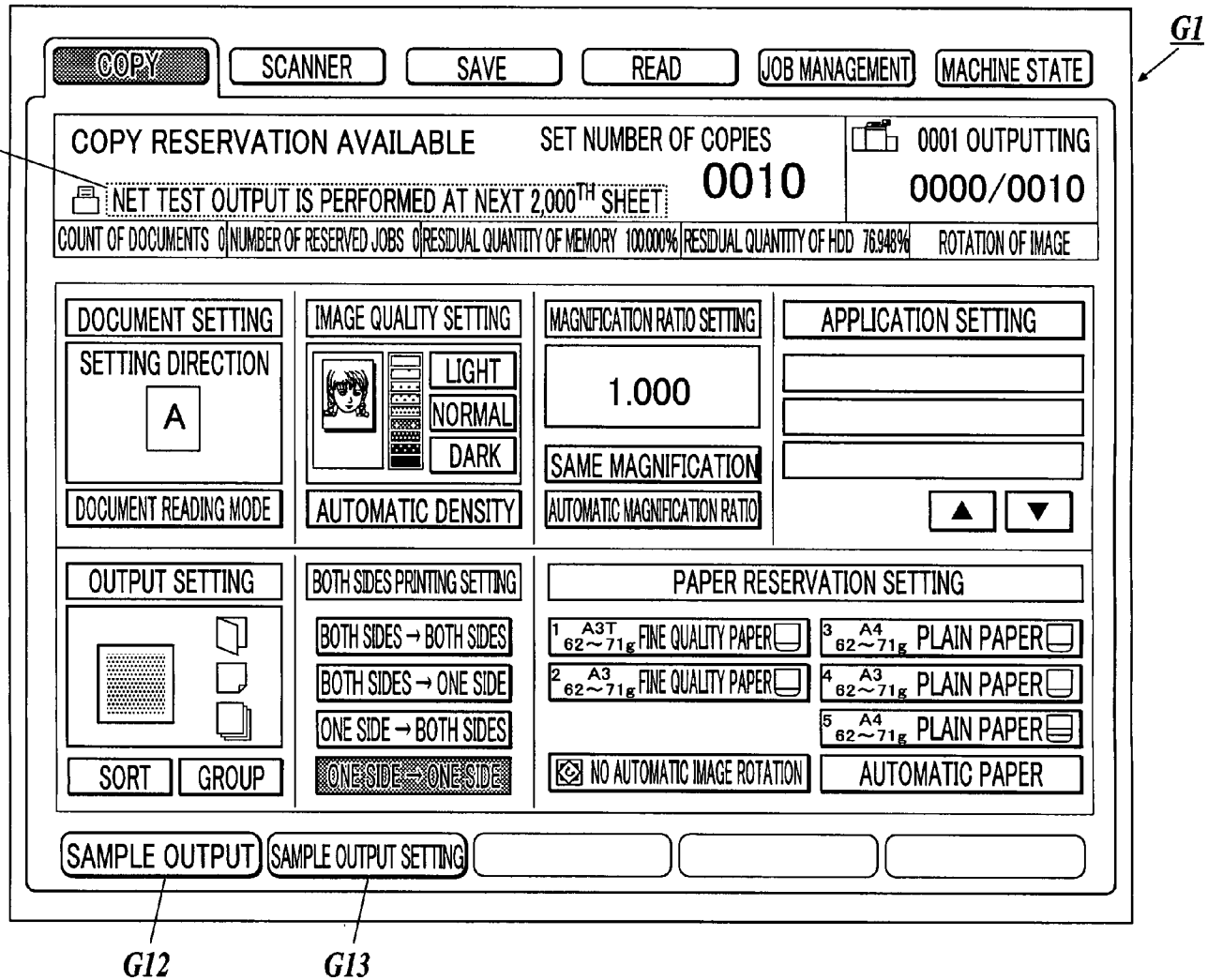
FIG. 4 is a view showing an example of a basic setting screen.
Figure 5:
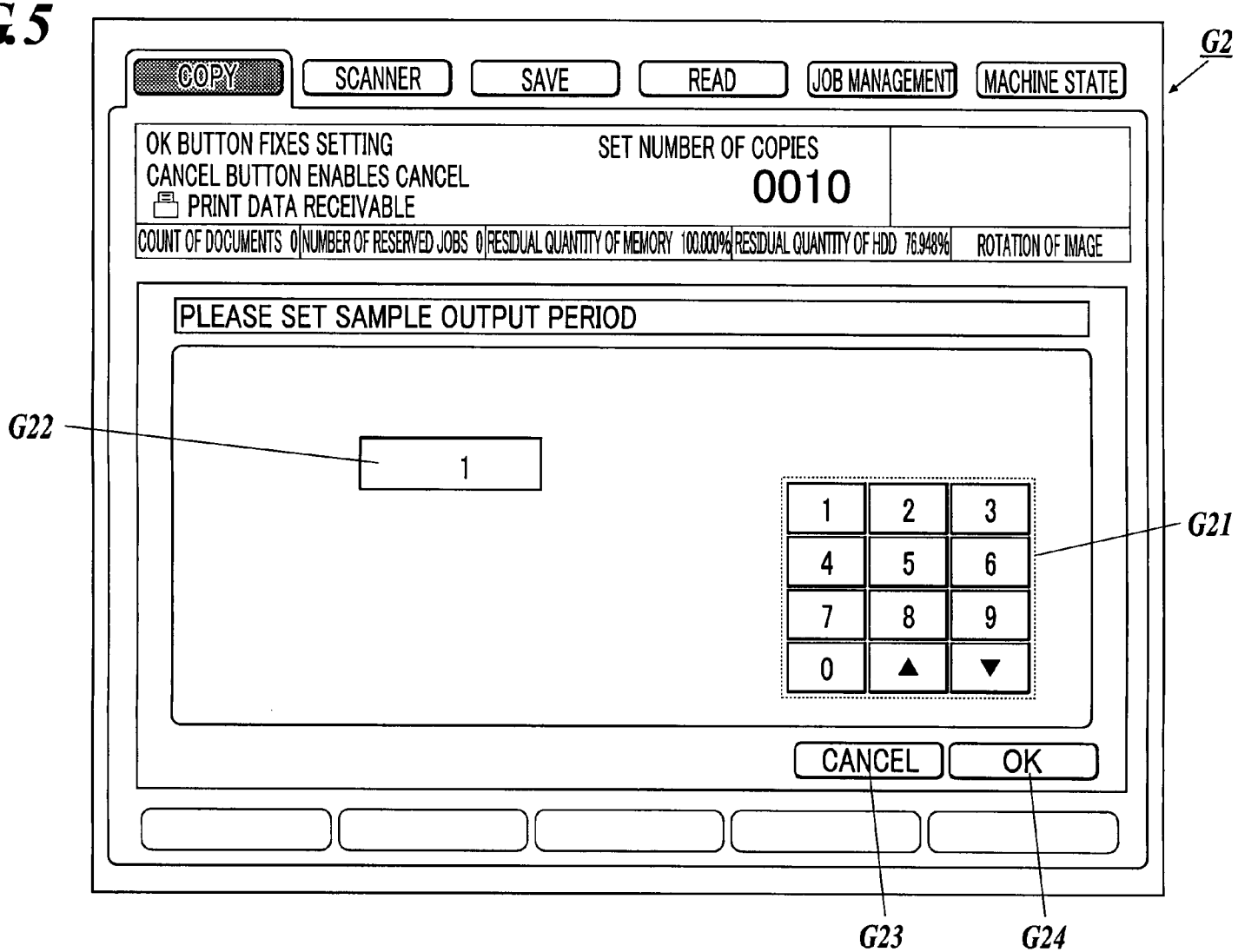
FIG. 5 is a view showing an example of a cycle setting screen.

The various setting screens as shown in FIGS. 4 and 5 are displayed on the touch panel 31 of the operation display section 30. FIG. 4 shows an example of a basic setting screen G1, and FIG. 5 shows an example of a cycle setting screen G2 as the first input section.

As shown in FIG. 4, the basic setting screen G1 includes buttons and the like to perform various kinds of setting in the image forming apparatus 1. Furthermore, the basic setting screen G1 includes a message region G11, a sample output button G12, and a sample output setting button G13 in the embodiment.

The message region G11 realizes the function of the informing section to perform the information of the number of sheets (hereinafter referred to as a next sample output number of sheets M) of the recording media (hereinafter referred to sheets of paper) to be ejected by the ejection of a sample print, for example, the display of a message of "Next test output is performed at the next 2,000$^{th}$ sheet," as the timing of executing sample output (hereinafter referred to as sample printing), or the timing until sample output matter (hereinafter referred to sample print) is ejected in the embodiment.

The next sample output number of sheets M shown in the message to be displayed in the message region G11 decreases every ejection of a sheet of paper, and returns to the value of a cycle of the number of sheets K, which is previously set by a user in the cycle setting screen G2 and will be described below, of the sample printing by the ejection of the sample print.

The sample output button G12 realizes the function of an operation section to receive an input of an immediate ejection instruction of a sample print, that is, an immediate output instruction of a sample print. The sample output setting button G13 receives an input of a switching instruction to the cycle setting screen G2.

An operator can execute sample printing at arbitrary timing with the sample output button G12.

As shown in FIG. 5, the cycle setting screen G2 is a screen to be displayed by an operation of the sample output setting button G13. The cycle setting screen G2 includes an input key group G21 to set an output cycle of a sample print, or an ejection cycle (hereinafter referred to as the cycle of the number of sheets K) of a sample print in the embodiment; a display area G22 to display the input cycle of the number of sheets K; a cancel button G23; and an OK button G24. An operation of the OK button G24 sets the value displayed in the display area G22 as the cycle of the number of sheets K.

The printer section 40 performs electrophotographic printing system image formation, and is composed of a conveyance mechanism 41 to convey the paper fed from the paper feeding unit 50, an image forming section 42 to perform image formation on the paper, and a fixing section 43 to fix a toner image formed on the paper.

The image forming section 42 is composed of a photosensitive drum, which is an image carrying body; a charging section to perform the charging of the photosensitive drum; an exposing section made of a laser diode (LD) or the like to perform exposure scanning to the surface of the photosensitive drum on the basis of image data; a developing section to adhere toner onto the photosensitive drum; a transferring section to transfer the toner image formed on the photosensitive drum onto a sheet of paper; and a cleaning section to remove the residual toner on the photosensitive drum.

Incidentally, although the printer section 40 is supposed to perform the electrophotographic printing system image formation in the embodiment, the printing system is not limited to this one. The other image formation systems, such as an ink-jet system, a thermal transfer system, and a dot-impact system, may be adopted.

The paper feeding unit 50 is composed of the four paper feeding trays of the paper feeding trays 51-54. Incidentally, although the embodiment is supposed to be equipped with the four paper feeding trays, the number of the paper feeding trays is not to be limited to the particular four. Each of the paper feeding trays 51-54 can house sheets of paper having mutually different paper types, such as sheets of plain paper, backing paper, recycled paper, and fine quality paper, and having different paper sizes.

The stacker 610 receives ejected sheets of paper on each of which an image is formed by the main body unit 1*a* as printed matter, and loads a great deal of printed matter to accumulate it. The stacker 610 is composed of a sub-tray 611 and a loading stage 612.

The sub-tray 611 loads a sheet of paper (sample print) ejected from the main body unit 1*a* on which sheet an image is formed on the basis of sample image data. The loading stage 612 loads a sheet of paper (regular printed matter) ejected from the main body unit 1*a* on which sheet an image formed on the basis of the image data of a job.

As shown in FIG. 2, the stacker 610 includes the door 613 and a taking-out button 614. The door 613 is provided on the front face of the loading stage 612. The door 613 is opened at the time of taking out the regular printed matter accumulated on the loading stage 612, and is closed at the time of a regular operation and printing. The taking-out button 614 is a button to open the door 613 by being depressed.

In the stacker 610, the sheets of paper (regular printed matter P) on which images are formed are loaded on the loading stage 612. The loading stage 612 moves up and down according to the amount of the regular printed matter P. In the stacker 610, the regular printed matter that is ejected from the main body unit 1*a* passes a first root r1 to be ejected on the loading stage 612, and the sample print that is ejected from the main body unit 1*a* passes a second root r2 of paper ejection to be ejected to the sub-tray 611.

Moreover, image forming apparatus 1 of the embodiment may be configured to be further provided with a post-processing device to perform various kinds of post-processing, such as sorting processing, punching (perforating) processing, stapling processing, center-bending processing, and cutting processing to the paper on which an image is formed.

The internal configuration of the image forming apparatus 1 is described with reference to FIG. 3.

The image forming apparatus 1 is composed of the main body control board 100, a printer controller 10, the image reading section 20, the operation display section 30, the printer section 40, the stacker 610, a hard disk drive (HDD) 70, and the like.

The printer controller 10 is composed of a controller control section 11, a DRAM control IC 12, an image memory 13, a communication control section 14 as a communication section to perform communication with an external device 2 connected through a network 3, and a network interface card (NIC) 15.

The controller control section 11 collectively controls the operation of each section, and realizes the function of distributing the image data and the set information of a printing job to the main body control board 100 which image data and set information have been transmitted from the external device 2 on the network 3 through the communication control section 14 and the NIC 15. As the external device 2, the other external devices such as a personal computer (PC), a server apparatus, and portable equipment may be adopted.

The DRAM control IC 12 controls the storage of the image data and the information pertaining to a job, which have been received by the NIC 15 and the communication control section 14 into the image memory 13, and controls the reading of image data and the information pertaining to a job from the image memory 13. Moreover, the DRAM control IC 12 is connected to a DRAM control IC 160 of the main body control board 100 through a peripheral component interconnect (PCI) bus. The DRAM control IC 12 reads the image data of a printing object and a job pertaining to set information from the image memory 13, and outputs the read image data and the job to the DRAM control IC 160 in accordance with an instruction from the controller control section 11.

The image memory 13 is composed of a DRAM, and temporarily stores input image data and a job pertaining to the set information.

The communication control section 14 controls the communication of the NIC 15. The NIC 15 is a communication interface to perform the connection with the network 3, and receives the image data of the printing object and the set information from the external device 2 through the network 3. The received image data and the set information are output to the DRAM control IC 12.

The image reading section 20 is composed of the ADF section 21 shown in FIG. 1, the scanner section 22 including a CCD 23, and an image reading processing section 24. The image reading processing section 24 controls the ADF section 21 and the scanner section 22 to allow them to execute the light scanning on an document surface to output the read analog image signal to a reading processing section 140 in accordance with an instruction of a control section 110.

The operation display section 30 is composed of the touch panel 31, which is integrally configured with the liquid crystal display (LCD), not-shown various function keys, and an operation display control section 32. The operation display control section 32 outputs operation signals generated by the operations of the various function keys or the touch panel 31 to the control section 110. Moreover, the operation display control section 32 allows the LCD to display various operation screens, various processing results, and the like, in accordance with the instructions from the control section 110.

The printer section 40 is composed of each section such as the image forming section 42, which concerns printing, and a printer control section 44. The printer control section 44 controls the operation of each section of the printer section 40 in accordance with instructions from the control section 110, and allows the image forming section 42 and the like to perform image formation on paper on the basis of the image data input from a writing processing section 190.

The stacker 610 is composed of the taking-out button 614, a stacker control section 615, a door sensor 616, a conveyance path switching member 617, and a paper ejection sensor 618.

The stacker control section 615 controls each section in the stacker 610 in accordance with the control of the control section 110. The various sensors of the door sensor 616, the paper ejection sensor 618, and the like, output various detection signals to the stacker control section 615.

The door sensor 616 detects whether the door 613 is opened or not, and outputs the detection signal thereof. The paper ejection sensor 618 detects the ejection of a sheet of paper after image formation thereon, and outputs the detection signal thereof.

The stacker control section 615 controls the conveyance path switching member 617 to control the ejection of a sheet of paper to the sub-tray 611 or the loading stage 612 on the basis of the detection signals of the door sensor 616 and the paper ejection sensor 618 in accordance with the control of the control section 110.

The HDD 70 stores information in the state of being readable and writable. The HDD 70 particularly stores compressed image data compressed by a compression IC 150 as it will be described below.

The main body control board 100 is composed of the control section 110, a nonvolatile memory 120, the reading processing section 140, the compression IC 150, a dynamic random access memory (DRAM) control IC 160, an image memory 170, an expansion IC 180, and the writing processing section 190.

The control section 110 is composed of a central processing unit (CPU), a random access memory (RAM), and the like, and performs the integrated control of each section of the image forming apparatus 1. The control section 110 reads a specified program out of the system program and various application programs that are stored in the nonvolatile memory 120 to expand the read program in the RAM, and executes various kinds of processing in corporation with the program expanded in the RAM.

The control section 110 receives an input of an ejection cycle (a cycle of the number of sheets K) of a sample print through the operation display section 30 and sets the cycle of the number of sheets K in corporation with setting processing program of the cycle of the number of sheets, which will be described below.

Moreover, the control section 110 allows the printer section 40 to form image based on regular image data on a sheet of paper and allows the printer section 40 to eject the paper to which the image formation has been performed to the loading stage 612 as regular printed matter in corporation with an image formation processing program, which will be described below. Furthermore, the control section 110 counts the number of sheets of the ejected regular printed matter, and judges the timing of allowing the printer section 40 to eject a sample print (that is, the timing of executing the sample printing) according to the counted value N and the set cycle of the number of sheets K. Then, the control section 110 allows the printer section 40 to eject the sheet of paper on which image formation has been performed as the sample print according to the result of the judgment, and initializes the counted value N. Moreover, the control section 110 allows the printer section 40 to perform image formation to eject a sample print and initializes the counted value N when the immediate ejection of a sample print (that is, the immediate outputting of a sample print) is instructed by the external device 2 connected through the operation display section 30 or the printer controller 10.

Furthermore, the control section 110 calculates the number of sheets of paper (regular printed matter) to be ejected every ejection of the regular printed matter by the execution of the next sample printing (by the ejection of the next sample print), and allows the operation display section 30 to inform the calculated number of sheets (the next sample output number of sheets M) as the timing of the execution of sample printing (the timing until the ejection of the sample print).

Moreover, the control section 110 performs the control of allowing the HDD 70 to store the compressed image data compressed by the compression IC 150 and the compressed image data stored in the compression memory 171.

The nonvolatile memory 120 is a flash memory or the like, and stores various programs and data to be rewritable. The nonvolatile memory 120 stores the setting processing program of the cycle of the number of sheets, the image formation processing program, the set cycle of the number of sheets K, and the like.

The reading processing section 140 performs various kinds of processing, such as analog processing, A/D conversion processing, and shading processing, to the analog image signal input from the image reading processing section 24 of the image reading section 20 to generate digital image data. The generated digital image data is output to the compression IC 150. The compression IC 150 performs compression processing to the digital image data input from the reading processing section 140 or the printer controller 10 to output the compressed digital image data to the DRAM control IC 160.

The DRAM control IC 160 controls the compression processing of the digital image data by the compression IC 150 and the expansion processing of the compressed image data by the expansion IC 180 in conformity with the instructions from the control section 110, and performs input-output control of image data against the image memory 170. For example, when the saving of an analog image signal read by the image reading section 20 is instructed, the DRAM control IC 160 allows the compression IC 150 to execute the compression processing of the digital image data input from the reading processing section 140, and allows the compression memory 171 of the image memory 170 to store the compressed image data.

Moreover, when the DRAM control IC 160 is instructed to print and output the compressed image data stored in the compression memory 171, the DRAM control IC 160 reads the compressed image data from the compression memory 171, and allows the expansion IC 180 to perform the expansion processing of the read compressed image data to allow a page memory 172 to store the expanded image data. Furthermore, when the DRAM control IC 160 is instructed to print and output the uncompressed image data stored in the page memory 172, the DRAM control IC 160 reads the uncompressed image data from the page memory 172 to output the read uncompressed image data to the writing processing section 190.

The image memory 170 is composed of the compression memory 171, such as the DRAM, and the page memory 172. The compression memory 171 is a memory for storing compressed image data. The page memory 172 is the memory for temporarily storing the uncompressed image data of the printing output object before printing.

The expansion IC 180 performs the expansion processing of the input compressed image data. The writing processing section 190 generates print data for performing image formation on the basis of the uncompressed image data input from the DRAM control IC 160, and outputs the generated print data to the image forming section 42 of the printer section 40.

Moreover, when the printer section 40 performs the image formation of the image data of a document read by the image reading section 20, a user input the set conditions of printing and the like with the operation display section 30. The control section 110 produces the set information of a job on the basis of the operation information with the operation display section 30. The read image data is compressed by the compression IC 150 by the control of the control section 110, and the compressed image data is stored in the image memory 170 together with the set information of the job. The compressed image data is expanded to be subjected to image formation.

Moreover, the job pertaining to the image data and the set information received from the external device 2 through the printer controller 10 is temporarily stored in the page memory 172 through the DRAM control IC 160 by the control of the control section 110. The image data stored in the page memory 172 is compressed by the compression IC 150 through the DRAM control IC 160, and, after that, the compressed image data is stored in the compression memory 171 together with the set information of the job by the control of the control section 110.

Next, the external device 2 is described.

Figure 6:
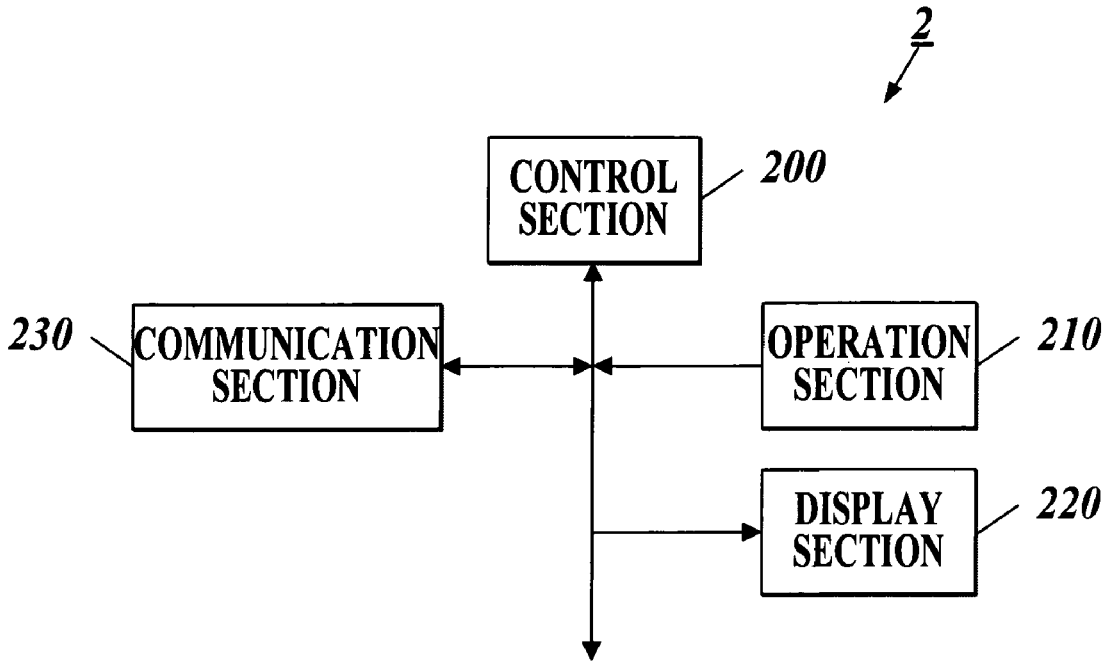
FIG. 6 is a diagram showing the internal configuration of an external device.

FIG. 6 shows the internal configuration diagram of the external device 2.

As shown in FIG. 6, the external device 2 includes a control section 200, an operation section 210, a display section 220, a communication section 230, and the like, and each section is electrically connected to one another.

The control section 200 includes a central processing unit (CPU), a read only memory (ROM), a nonvolatile memory such as a hard disk drive (HDD), a random access memory (RAM), and the like. The control section 200 expands a system program, various control programs, various kinds of data, and the like, which are stored in the nonvolatile memory into a work area formed in the RAM, and collectively controls the whole operation of the external device 2 in corporation with the expanded programs and data. Moreover, the control section 200 executes various kinds of processing in accordance with the programs expanded in the RAM, and allows the RAM to store the processing results and allows the display section 220 to display the processing results.

Moreover, the control section 200 instructs the image forming apparatus 1 to execute the setting processing of the cycle of the number of sheets, the image formation processing, and the like, in corporation with an application software program, a printer driver program to execute a printer driver, and various kinds of data that are stored in the nonvolatile memory 120. The control section 200 allows the RAM to store the processing results, and allows the display section 220 to display the processing results.

The operation section 210 is composed of a keyboard including numeric keys, character keys, cursor move keys, various function keys, and the like, for inputting operation instructions into the external device 2 and the image forming apparatus 1; and a pointing device, such as a mouse. The operation section 210 outputs a depression signal with the keyboard and an operation single with the mouse to the control section 200 as input signals.

The display section 220 is composed of a liquid crystal display (LCD) or the like, and displays various setting screens on the display screen thereof in accordance with the display signals input from the control section 200.

Moreover, the various setting screens such as the aforesaid basic setting screen G1 and the aforesaid cycle setting screen G2, as shown in FIGS. 4 and 5, are displayed on the display section 220.

The function of the first input section to set the ejection cycle of sample pints (hereinafter referred to as the cycle of the number of sheets K) and the function of the second input section to receive an input of an immediate output instruction of a sample print are realized by the various setting screens displayed on the display section 220, and by depression signals or operation signals with the operation section 210. Moreover, the display section 220 realizes the function of the informing section to inform the number of sheets of paper to be output by a sample print is output (the next sample output number of sheets M) by displaying the basic setting screen G1.

A sample print can be arbitrarily ejected from the external device 2 with the operation section 210 and the display section 220.

The communication section 230 is composed of various interfaces, such as a network interface card (NIC), a modulator-demodulator (MODEM), and a universal serial bus (USB), and performs mutual transmission and reception with the image forming apparatus 1 on the network 3.

Figure 7:
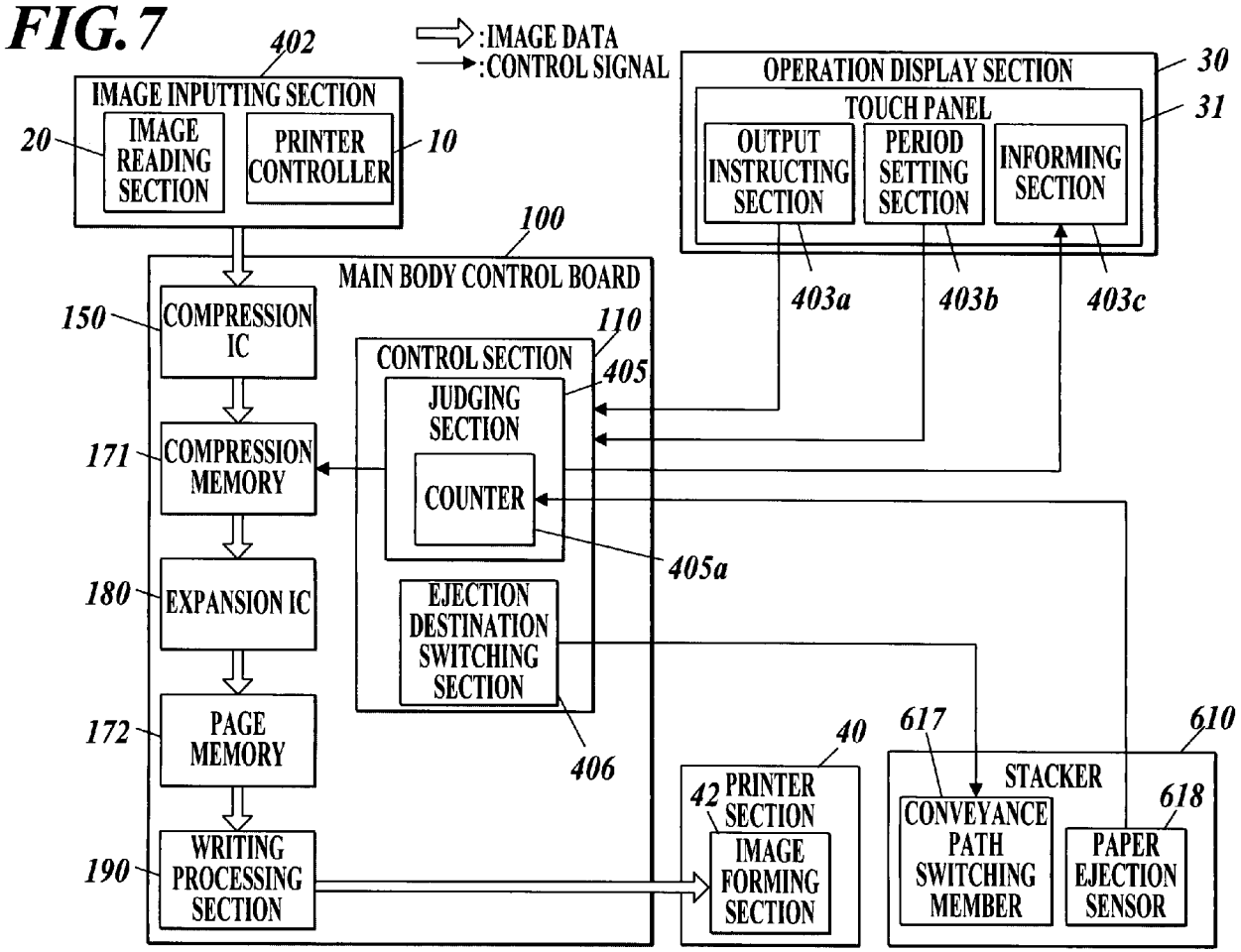
FIG. 7 is a diagram showing the functional configuration of the image forming apparatus of the embodiment.

FIG. 7 shows a functional configuration diagram of the image forming apparatus 1 of the embodiment.

As shown in FIG. 7, the image forming apparatus 1 is composed of an image inputting section 402, an output instructing section 403*a*, a cycle setting section 403*b*, an informing section 403*c*, a judging section 405 including a counter 405*a*, and an ejection destination switching section 406 as the functional configuration in the setting processing of the cycle of the number of sheets and the image formation processing in the embodiment.

The image inputting section 402 includes the printer controller 10 and the image reading section 20, and performs the input of the set information and the image data of a job executed in the image reading section 20 and the image data and the set information of a job transmitted from the external device 2 through the printer controller 10.

The output instructing section 403*a* is composed of the touch panel 31 of the operation display section 30, and is the above-mentioned sample output button G12. The output instructing section 403*a* receives an instruction of the immediate output of a sample print. The cycle setting section 403*b* is the above-mentioned cycle setting screen G2 composed of the touch panel 31 of the operation display section 30, and receives a setting instruction of an ejection cycle of sample prints (the cycle of the number of sheets K). The informing section 403*c* is the message region G11 to be displayed on the touch panel 31 of the operation display section 30, and informs the timing of the ejection of a sample print (the next sample output number of sheets M).

The judging section 405 includes the counter 405*a* to count the number of the ejected sheets of paper of regular printed matter according to the detection signals input from the paper ejection sensor 618, and monitors the number of the ejected sheets of the regular printed matter according to the cycle of the number of sheets K input from the cycle setting section 403*b* to be set and the counted value N of the counter 405*a*. When the number of the ejected sheets (the counted value N of the counter 405*a*) of the regular printed matter reaches the cycle of the number of sheets K, the judging section 405 executes sample printing to eject a sample print, and initializes the counted value N. Moreover, when the immediate output of a sample print is instructed by the output instructing section 403*a*, the judging section 405 executes sample printing to eject a sample print, and initializes the counted value N.

The ejection destination switching section 406 controls the stacker control section 615 so as to switch the ejection destination of paper to the sub-tray 611 or the loading stage 612, and allows the stacker control section 615 to switch the conveyance path switching member 617.

Next, the operation of the embodiment is described.

Figure 8:
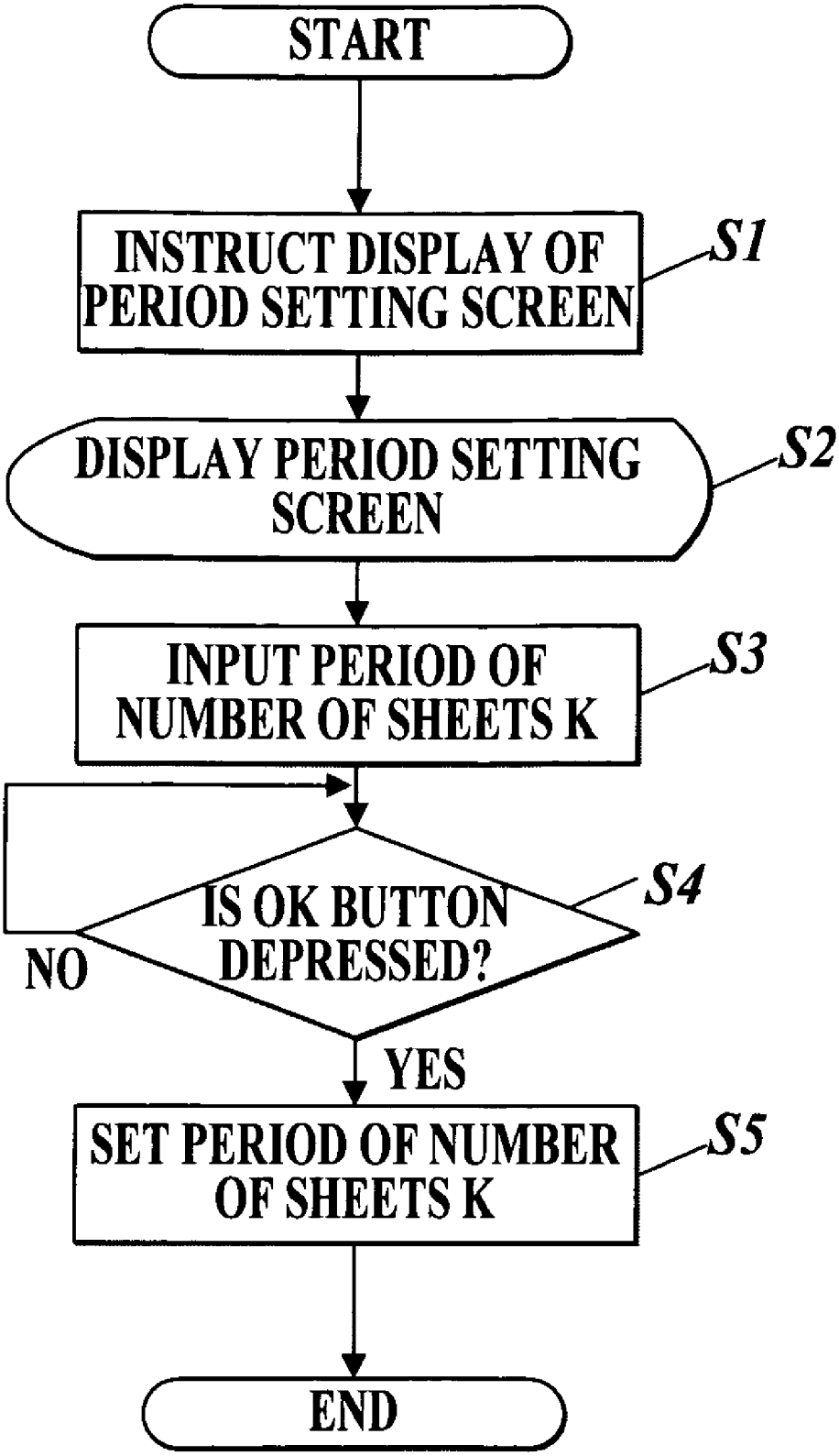
FIG. 8 is a flow chart showing the setting processing of the cycle of the number of sheets of the embodiment.

FIG. 8 shows a flow chart of the setting processing of the cycle of the number of sheets in the embodiment.

The setting processing of the cycle of the number of sheets in the embodiment is executed by the control section 110 at the time of, for example, a depression of the sample output setting button G13 on the basic setting screen G1 displayed in the operation display section 30 as a trigger in accordance with the setting processing program of the cycle of the number of sheets read from the nonvolatile memory 120 to be expanded in the RAM.

By the depression of the sample output setting button G13 on the basic setting screen G1 displayed in the touch panel 31 of the operation display section 30, a display instruction of the cycle setting screen G2 is input (step S1), and the cycle setting screen G2 is displayed on the touch panel 31 of the operation display section 30 in response to the instruction (step S2).

When the cycle setting screen G2 is displayed, an input of the cycle of the number of sheets K with the input key group G21 on the cycle setting screen G2 is received (step S3), and it is judged whether the OK button G24 is depressed or not (step S4). If the OK button G24 is not depressed (step S4; No), then the processing returns to the step S4.

If the OK button G24 is depressed (step S4; Yes), then the value displayed on the display area G22 is set in the nonvolatile memory 120 as the cycle of the number of sheets K (step S5), and the present processing is ended.

FIG. 9 shows a flow chart of the image formation processing in the embodiment.

The image formation processing in the embodiment is executed by the control section 110 at the time of, for example, the turning-on of the power source of the image forming apparatus 1 by a user with the operation display section 30 as a trigger in accordance with the image formation processing program read from the nonvolatile memory 120 to be expanded in the RAM.

When the power source of the image forming apparatus 1 is first turned on with the operation display section 30 (step S11), the control section 110 clears the counted value N of the counter 405*a* (N=0) (step S12).

A job is then input with the image inputting section 402, and it is judged whether the input job should be started to be executed or not (step S13). If the execution of the job should not be started (step S13; No), then the processing returns to the step S13.

If the execution of the job should be started (step S13; Yes), then it is judged whether an instruction of an immediate output of a sample print, that is, an instruction of immediate ejection of a sample print with a depression of the sample output button G12, is received or not (step S14).

If sample output button G12 is not depressed and no instructions of the immediate ejection of a sample print are not received (step S14; No), then the image data from the image inputting section 402 is compressed by the compression IC 150, and the compressed image data is stored in the compression memory 171. The compressed image data stored in the compression memory 171 is then expanded by the expansion IC 180, and the expanded image data is stored in the page memory 172 (step S15).

A sheet of paper is then fed from the paper feeding unit 50 in response to an instruction from the control section 110 (step S16). The image formation based on the image data onto the paper fed at the step S16 is then performed in the image forming section 42 in response to the instruction from the control section 110 (step S17). The paper subjected to the image formation at step S17 is then ejected to the loading stage 612 as regular printed matter through the stacker control section 615 under control of the control section 110 (step S18).

When the regular printed matter is ejected at the step S18, a detection signal of the paper is output to the control section 110 by the paper ejection sensor 618 through the stacker control section 615. When the detection signal is input into the control section 110, the control section 110 counts up the counter 405*a* (increment by +1).

The judging section 405 of the control section 110 refers to the counted value N of the counter 405*a* to judge whether it is the timing of executing sample printing, that is, the timing of ejecting a sample print or not on the basis of whether the counted value N accords with the cycle of the number of sheets K set in the nonvolatile memory 120 (N=K) or not (step S20).

If the sample output button G12 is depressed and an immediate output instruction of a sample print is received (step S14; Yes), or if the judging section 405 judges that it is the timing of ejecting a sample print (step S20; Yes), then the execution of the sample output processing to form a sample print and eject the formed sample print is started (step S21).

If the judging section 405 judges that it is not the timing of ejecting a sample print (step S20; No), or after the step S21, the control section 110 refers to the counted value N of the counter 405*a*, and subtracts the counted value N from the cycle of the number of sheets K set in the nonvolatile memory 120 to calculate the next sample output number of sheets M. A message based on the calculated next sample output number of sheets M is displayed in the message region G11 in the basic setting screen G1 displayed on the touch panel 31 of the operation display section 30 by the control section 110 (step S22).

After the step S22, the control section 110 judges whether the job the execution of which has been started at the step S13 is ended or not (step S23). If the execution of the job is not ended (step S23; No), then the processing returns to the step S14.

If the control section 110 judges that the job the execution of which has been started at the step S13 is ended (step S23; Yes), the control section 110 judges whether the power source of the image forming apparatus 1 is turned off by the operation display section 30 or not (step S24). If the power source is not turned off (step S24; No), the processing returns to the step S13.

If the control section 110 judges that the power source of the image forming apparatus 1 is turned off with the operation display section 30 (step S24; Yes), then the present processing is ended.

Figure 10:
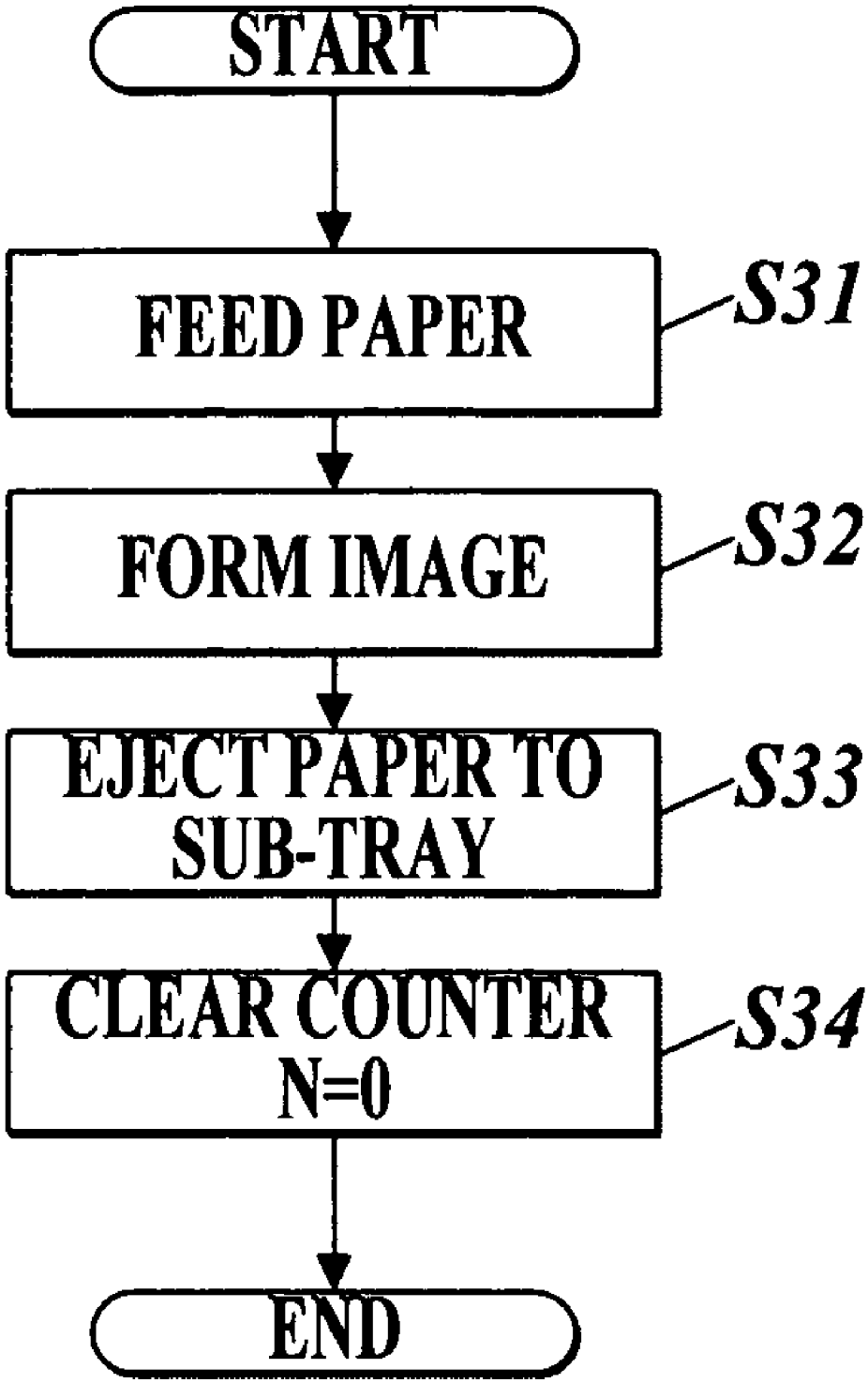
FIG. 10 is a flow chart showing the sample output processing of the embodiment.

FIG. 10 shows a flow chart of the sample output processing in the embodiment.

The sample output processing in the embodiment is executed by the control section 110 at the time when the sample output button G12 is depressed by a user with the operation display section 30 and an immediate output instruction of a sample print is received (step S14; Yes), or at the time when the judging section 405 judges that it is the timing of ejecting a sample print (step S20; Yes) in the image formation processing mentioned above by the use of the depression of the sample output button G12 or the judgment of the timing as a trigger in accordance with a sample output processing program that is read from the nonvolatile memory 120 and is expanded in the RAM.

A sheet of paper is fed from the paper feeding unit 50 on the basis of an instruction of the control section 110 (step S31). Image data is then formed as an image on the paper feed at the step S31 in the image forming section 42 by an instruction of the control section 110 (step S32). Incidentally, the image data to be formed as an image at the step S32 may be that for sample printing, that formed as an image before the execution of the present processing, or the like.

The paper on which the image formation has been performed at the step S32 is then ejected to the sub-tray 611 as a sample print through the stacker control section 615 by the control section 110 (step S33).

When the sample print is ejected at the step S33, a detection signal of the paper is output to the control section 110 through the stacker control section 615 by the paper ejection sensor 618. When the detection signal is input into the control section 110, the counted value N of the counter 405*a* is cleared (N=0), and the present processing is ended.

As described above, according to the embodiment, because the counted value N for performing sample printing can be initialized every cycle of the number of sheets K even when an operation instructs sample printing at arbitrary timing in the case where sample printing is set to be performed every set cycle of the number of sheets K, an unnecessary sample print can be prevented to be ejected, that is, unnecessary sample printing can be prevented to be executed, and the convenience of the image forming apparatus can be improved.

Moreover, because the next sample output number of sheets M can be informed as the timing of ejecting the next sample print by the ejection of the sample print, the timing of ejecting the next sample printing can be easily confirmed.

Moreover, the present invention is not limited to the contents of the above embodiment, and can be suitably changed.

According to the first aspect of the invention, an image forming apparatus includes: a first input section to receive a setting instruction of an output cycle of sample output; a second input section to receive an instruction of immediate output of the sample output; an image forming section to form an image onto a recording medium based on image data; an ejection section to eject the recording medium subjected to image forming; a control section to count the number of the recording medium ejected by the ejection section, the control section to judge timing of executing the sample output, at which the image forming section forms an image, based on a counted value of the number of recording media and the output cycle set by the first input section, the control section to execute the sample output of the sample output matter formed by the image forming section according to a judgment result and simultaneously initializes the counted value, and the control section to execute the sample output of the sample output matter formed by the image forming section when the immediate output of the sample output is instructed with the second input section and simultaneously initializes the counted value.

The above image forming apparatus can prevent the execution of an unnecessary sample output even when an operator instructs the sample output at arbitrary timing in the case where sample output is set to be performed every predetermined cycle, and the convenience of the image forming apparatus can be improved.

Preferably, the image forming apparatus further comprises an informing section to inform the timing of executing the sample output, wherein the control section calculates the number of the recording media ejected into the ejection section by execution of a next sample output, and allows the informing section to inform the calculated number of the recording media as the timing of executing the sample output.

Because the above image forming apparatus can inform the number of the recording media to be ejected into the ejection section until the execution of the next sample output as the timing of executing the sample output, the execution timing of the sample output can be easily confirmed.

Preferably, the second input section includes an operation section to receive input of the immediate output instruction of the sample output matter, and execution of the sample output is instructed based on the output instruction received by the operation section.

The above image forming apparatus can arbitrarily execute the sample output.

Preferably, the image forming apparatus further comprises a communication section to communicate with an external device, wherein the second input section instructs execution of the sample output based on a signal received by the communication section.

The above image forming apparatus can arbitrarily execute the sample output with the external device.

The present U.S. patent application claims a priority under the Paris Convention of Japanese patent application No. 2007-082220 filed on Mar. 27, 2007, which shall be a basis of correction of an incorrect translation.

What is claimed is:

1. An image forming apparatus comprising:

a first input section to receive a setting instruction of an output cycle of a sample output which represents a number of regular prints to be outputted each cycle before executing the sample output;

a second input section to receive an instruction of an immediate output of the sample output;

an image forming section to form an image onto a recording medium based on image data;

an ejection section to eject the recording medium subjected to the image forming; and a control section to: (i) count a number of recording media ejected by the ejection section, (ii) judge a timing of executing the sample output, at which the image forming section forms an image, based on a counted value of the number of the recording media of the regular prints and the output cycle of the sample output set by the first input section, (iii) execute the sample output of a sample output matter by the image forming section and simultaneously initialize the counted value, according to the judgment result, and (iv) execute the sample output of the sample output matter by the image forming section and simultaneously initialize the counted value when the immediate output of the sample output is instructed with the second input section.

2. The image forming apparatus of claim 1, further comprising an informing section to inform the timing of executing the sample output, wherein the control section calculates a number of the recording media of the regular prints to be ejected by the ejection section before a next execution of the sample output, and controls the informing section to inform the calculated number of the recording media of the regular prints as the timing of executing the sample output.

3. The image forming apparatus of claim 1, wherein the second input section includes an operation section to receive an input of the immediate output instruction of the sample output matter, and wherein execution of the sample output is instructed based on the immediate output instruction received by the operation section.

4. The image forming apparatus of claim 1, further comprising a communication section to communicate with an external device, wherein the second input section instructs execution of the sample output based on a signal received by the communication section.

* * * * *